US007549372B2

(12) United States Patent
Bernard et al.

(10) Patent No.: US 7,549,372 B2
(45) Date of Patent: Jun. 23, 2009

(54) PRINTING MACHINE AND PRINTING MACHINE SYSTEM

(75) Inventors: Andreas Ewald Heinrich Bernard, Sulzfeld (DE); Manfred Herrmann Liebler, Erlenbach (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 350 days.

(21) Appl. No.: 10/562,468

(22) PCT Filed: Jun. 21, 2004

(86) PCT No.: PCT/EP2004/051178

§ 371 (c)(1),
(2), (4) Date: Dec. 27, 2005

(87) PCT Pub. No.: WO2005/007408

PCT Pub. Date: Jan. 27, 2005

(65) Prior Publication Data

US 2007/0095225 A1 May 3, 2007

(30) Foreign Application Priority Data

Jul. 11, 2003 (DE) ..... 103 31 595
Mar. 15, 2004 (DE) ..... 10 2004 012 560

(51) Int. Cl.
*B41F 5/00* (2006.01)

(52) U.S. Cl. ..... 101/216; 101/219

(58) Field of Classification Search ..... 101/216, 101/219, 227, 136, 142, 180, 220
See application file for complete search history.

(56) References Cited

U.S. PATENT DOCUMENTS

| | | | | | |
|---|---|---|---|---|---|
| 3,966,105 | A * | 6/1976 | Curran | 226/21 |
| 4,031,824 | A * | 6/1977 | Bubley et al. | 101/126 |
| 4,812,842 | A | 3/1989 | Bayerlein et al. | |
| 5,117,753 | A | 6/1992 | Mamberer | |
| 5,537,920 | A * | 7/1996 | Hasegawa et al. | 101/116 |
| 5,640,906 | A * | 6/1997 | Schmitt | 101/177 |
| 5,950,538 | A | 9/1999 | Puschnerat | |
| 5,975,525 | A * | 11/1999 | Hartmann et al. | 271/315 |
| 6,167,806 | B1 * | 1/2001 | Chretinat et al. | 101/220 |
| 6,289,805 | B1 | 9/2001 | Douillard et al. | |
| 6,408,746 | B1 * | 6/2002 | Weschenfelder | 101/142 |
| 6,408,748 | B1 | 6/2002 | Hajek et al. | |

(Continued)

FOREIGN PATENT DOCUMENTS

DE 40 12 396 10/1991

(Continued)

*Primary Examiner*—Daniel J Colilla
*Assistant Examiner*—David Banh
(74) *Attorney, Agent, or Firm*—Jones, Tullar & Cooper, P.C.

(57) ABSTRACT

A printing machine is provided with a control panel for use in the printing machine's control. The control panel is located on one side of the printing machine which includes at least one printing unit which has at least one pair of cylinder. This at least one pair of cylinders are mechanically coupled to each other by a drive connection and are driven for rotation by a drive motor that is independent of other printing units. This drive motor and the drive connection are located on the control panel side of the printing unit.

16 Claims, 9 Drawing Sheets

U.S. PATENT DOCUMENTS

| | | | | |
|---|---|---|---|---|
| 6,502,508 | B1 * | 1/2003 | Schaede et al. | 101/216 |
| 6,644,184 | B1 | 11/2003 | Hajek et al. | |
| 6,779,446 | B2 | 8/2004 | Hajek et al. | |
| 6,848,846 | B2 * | 2/2005 | Codos et al. | 400/323.1 |
| 6,901,854 | B2 * | 6/2005 | Masuch | 101/216 |
| 7,044,054 | B2 * | 5/2006 | Stiel | 101/216 |
| 2003/0048324 | A1 * | 3/2003 | Fujimoto | 347/19 |

FOREIGN PATENT DOCUMENTS

| | | |
|---|---|---|
| DE | 43 06 098 | 9/1994 |
| DE | 196 03 663 | 8/1997 |
| EP | 0 243 811 | 4/1987 |
| EP | 0 699 524 A2 | 8/1995 |
| EP | 0 699 524 B1 | 8/1995 |
| EP | 1 125 734 | 1/2001 |
| GB | 2 275 444 | 8/1994 |
| GB | 2 309 668 | 8/1997 |

* cited by examiner

PRINTING MACHINE AND PRINTING MACHINE SYSTEM

CROSS-REFERENCE TO RELATED APPLICATIONS

This application is the U.S. national phase, under 35 U.S.C. 371, of PCT/EP 2004/051178, filed Jun. 21, 2004; published as WO 2005/007408 A2 and A3 on Jan. 27, 2005, and claiming priority to DE 103 31 595.0, filed Jul. 11, 2003, and to DE 10 2004 012 560.0 filed Mar. 15, 2004, the disclosures of which are expressly incorporated herein by reference.

FIELD OF THE INVENTION

The present invention is directed to printing presses, as well as a printing press system. The printing press system includes printing presses with operating sides and with sides facing away form the operating sides. Press drives can be located both on the operating sides and on the side facing away from the operating side.

BACKGROUND OF THE INVENTION

A drive mechanism for a printing group is known from EP 0 699 524 B1. A drive motor axially directly drives a forme cylinder, which forme cylinder drives the remaining cylinders of the printing group. In preferred embodiments with printing group cylinders which are mechanically coupled by a drive train, the drive motor which coaxially drives one of the cylinders is arranged on a lateral wall side I on the operating side, and the drive train is located on the side II of the printing group which side II is identified as drive side. In case of individual driving of all printing group cylinders by their own drive motors, these are arranged coaxially in respect to the respective cylinder, for example, on the side II, which is different from the lateral wall on the operating side which is side I.

DE 196 03 663 A1 discloses a drive mechanism of a forme cylinder by the use of a drive motor via a pinion gear.

DE 40 12 396 A1 discloses a printing press system with two printing presses which can be individually driven independently of each other and which are laterally spaced apart from each other. The printing units of one press can be driven together from a drive motor via respective shafts.

SUMMARY OF THE INVENTION

The object of the present invention is directed to producing printing presses, as well as a printing press system.

In accordance with the present invention, the object is attained by the provision of a printing press that has an operating side and a side facing away from, and spaced from, the operating side. at least one pair of cylinders, and including a forme cylinder and a transfer cylinder, which are mechanically coupled to each other by a drive connection, which drive connection may be located on the operating side of the printing unit or on the side facing away from the operating side. If there are multiple printing presses in the printing press systems, drive motors and drive connections for alternate presses may be arranged on alternate sides.

A substantial advantage which can be obtained by the present invention lies in that the outlay for planning, construction, manufacture and installation of a printing press, or of a printing press system, can be lowered, can be specifically designed for the most varied demands of the customer, or can be configured for his available space. No special productions are required, which would be apt to increase the outlay and the tendency for breakdowns. The various printing presses, or printing press systems can be modularly produced from identical, intermediate products. This is made possible by the orientation of the roll changer and/or of the printing group in any desired way and/or by the symmetrical preparation of required connecting points.

BRIEF DESCRIPTION OF THE DRAWINGS

Preferred embodiments of the present invention are represented in the drawings and will be described in greater detail in what follows.

Shown are in:

FIG. 1, a general, schematic side elevation view of a printing press, in

FIG. 2, a top, schematic representation of webs of different widths, in

FIG. 3, a schematic end view of a roll changer, in

FIG. 4, a side elevation view of a printing unit, in

FIG. 5, a perspective view of a frame with main drive, in

FIG. 6, a top plan view of a frame of a printing unit, in

DESCRIPTION OF THE PREFERRED EMBODIMENT

Figure 1:
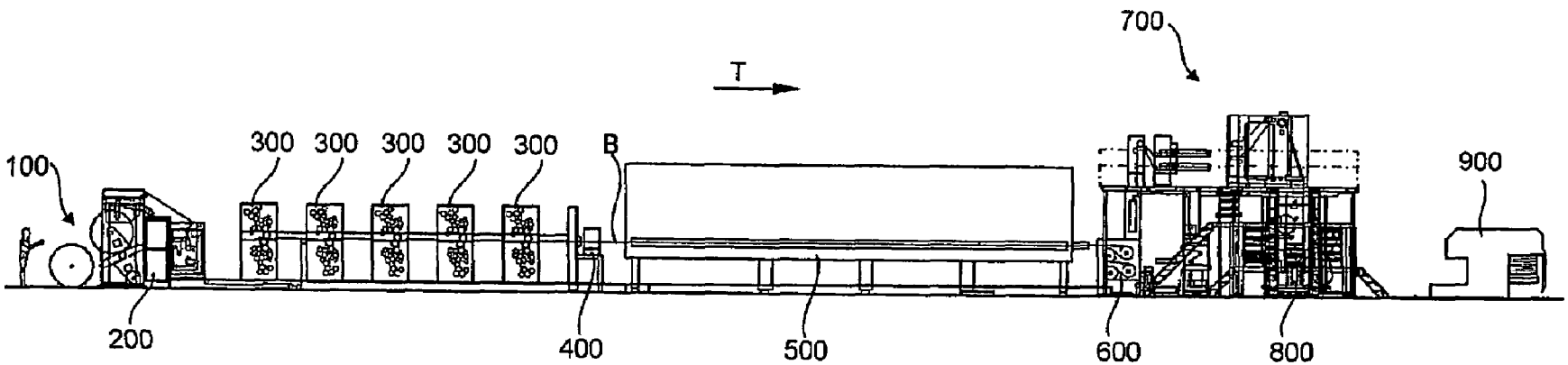
Figure 2:
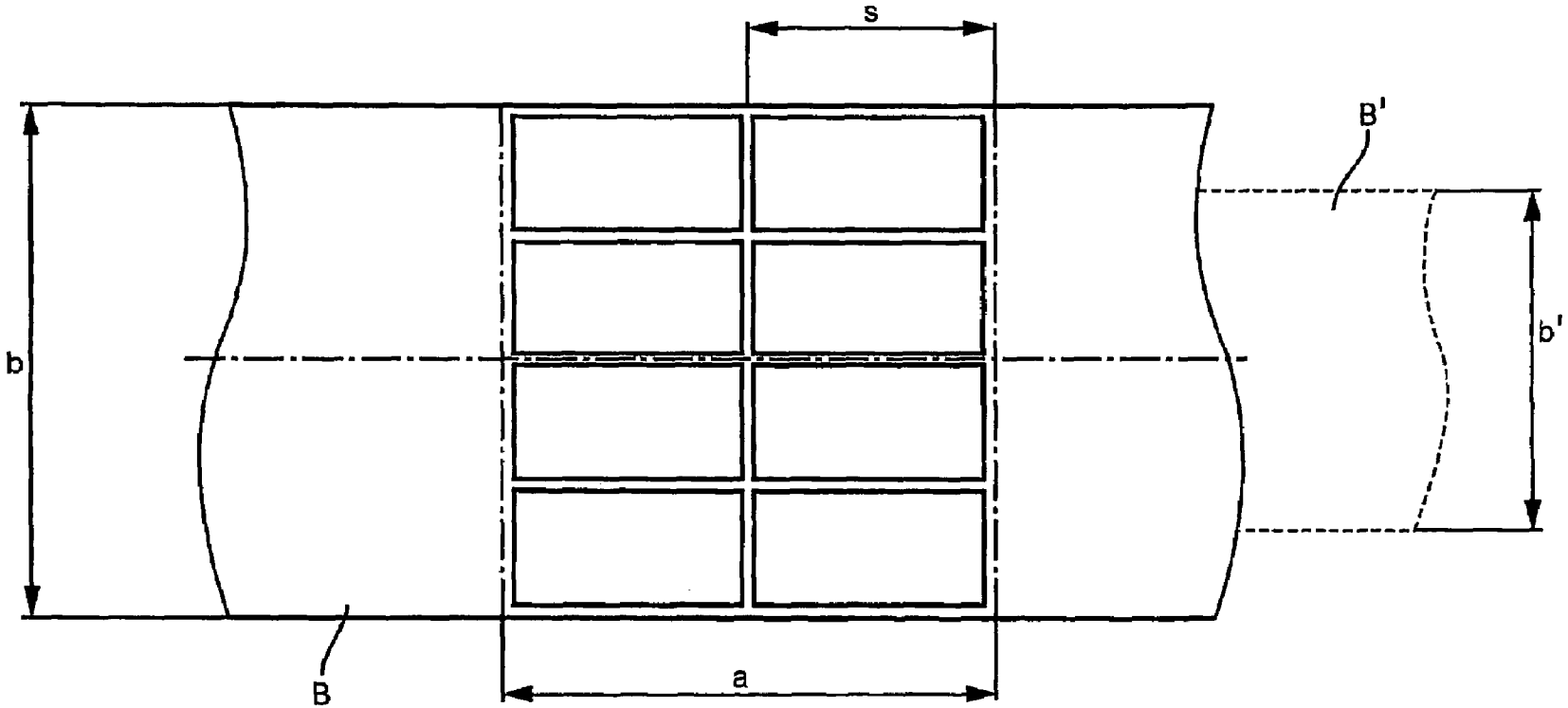

A printing press, and in particular a web-fed rotary printing press, for imprinting one or several webs B shown in FIG. 2 has, as seen in FIG. 1, several units 100, 200, 300, 400, 500, 600, 700, 800, 900, such as a material supply unit 100, units for imprinting and units for further processing. For example, the web B to be imprinted, and in particular a paper web B, is wound off a roll-unwinding device 100 before it is sent to one or to several printing units 300 via a draw-in unit 200. It is possible to provide the printing units 300, which are routinely intended for multi-color printing, such as, for example, four units for four-color printing, with additional printing units 300, which, in that case, can be alternatingly employed with one, or with several of the remaining printing units 300 for flying printing forme changes, for example.

In an advantageous embodiment it is possible to provide a varnishing unit 400 in the web path.

Following imprinting, and possibly varnishing, the web B passes through a dryer 500 and, if required, is cooled again in a cooling unit 600, in case drying had been performed thermally. Downstream of the dryer 500, or downstream of the cooling unit 600, it is possible to provide at least one further conditioning unit, which is not specifically represented in FIG. 1, such as a coating installation and/or a re-moistening device. Following cooling and/or conditioning, the web B can be conducted via a superstructure 700 to a folding apparatus 800. The superstructure 700 has at least a silicon unit, a longitudinal cutting device and a turning device, as well as a former unit which are not specifically depicted in FIG. 1. The silicon unit can also be arranged upstream of the superstructure 700, such as, for example, in the area of the cooling unit 600. The superstructure 700 furthermore can have, in a manner which is also not specifically represented in FIG. 1, a perforating unit, a gluing unit, a numbering unit and/or a plow fold. After passing through the superstructure 700, the web B, or a plurality partial webs, are conducted into the folding apparatus 800.

In an advantageous embodiment, the printing press additionally has a separate transverse cutter 900, such as, for example, a so-called open-sheet delivery unit, in which a web which, for example, had not been conducted through the folding apparatus 800, is cut into formatted sheets and, if desired, is stacked or delivered.

The units 100, 200, 300, 400, 500, 600, 700, 800, 900 of the printing press have an effective width transversely with respect to the transport direction T of the web B, which effective width permits processing of webs B of a maximum width "b", as seen in FIG. 2, of up to 1,000 mm, for example. Here, effective width is to be understood as the respective width, or the clear width, of the components that are either directly or indirectly working together with the web B, and which include, for example, rollers, cylinders, passages, sensor devices, actuating paths, etc., of the units 100, 200, 300, 400, 500, 600, 700, 800, 900, so that the web B can be processed, conditioned and conveyed in its full width b. Furthermore, the functionality, such as the, for example, material supply, web transport, sensor devices, or further processing of the units 100, 200, 300, 400, 500, 600, 700, 800, 900 is configured in such a way that webs B' of only partial width down to a width b' of only 400 mm can be processed in the printing press.

The units 100, 200, 300, 400, 500, 600, 700, 800, 900, which define, or which process, a section length "a", as seen in FIG. 2, have been configured in such a way that they define a section length "a", of, for example, between 540 and 700 mm, on the web B. The section length "a" advantageously lies between 540 and 630 mm. The section length "a" is around 620±10 mm in a special embodiment. In a further development of the printing press, the units 100, 200, 300, 400, 500, 600, 700, 800, 900 have been configured in such a way that, with a few changes, the printing press can be selectively arranged for section lengths of 546 mm, 578 mm, 590 mm or 620 mm. Thus, for example, substantially only an interchangeability of bearing elements for printing group cylinders, a matching of the drive mechanism, as well as a matching in the folding apparatus 800, or the transverse cutting device, all as will be discussed subsequently, is required for the change in order to equip the same printing press for formats which differ from each other. For example, the section length "a" is routinely occupied by four vertical printed pages, for example DIN A4, side-by-side in the transverse direction of the web B, and by two printed pages, each, for example, of a length "s" and disposed one behind the other in the longitudinal direction. However, depending on the printed image and on any subsequent further processing in the superstructure 700, and on the folding apparatus 800, other numbers of pages per section length "a" are possible.

Figure 3:
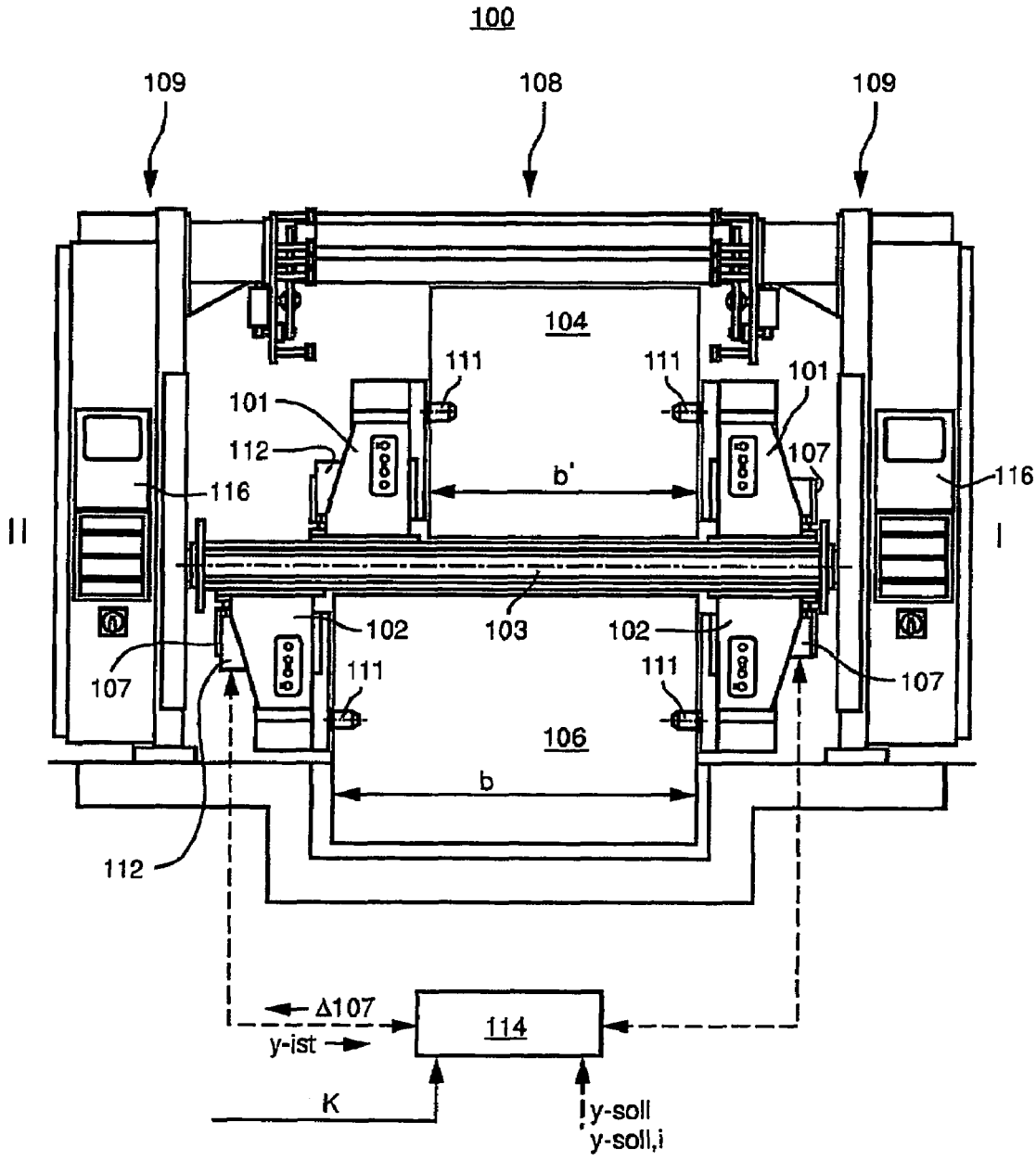

The roll-unwinding device 100 can be embodied as a stationary roll changer with web storage or advantageously, as represented in FIG. 3, can be embodied as a roll changer 100 for use in accomplishing a flying roll change. It has several, in this case two, pairs of support arms 101, 102, which are seated, respectively aligned in pairs parallel with respect to the axis of rotation of a roll 104, 106 to be unwound and which are individually movable. The separated, individually movable support arms 101, 102 make possible the simultaneous reception of rolls 104, 106 of different width b', b by the support arms 101 or 102, as seen in FIG. 3. Axial movement of the support arms occurs, for example, via drive motors 107 and/or via spindle drive mechanisms which are not specifically represented. The support 103 which, as a whole and which, as represented in FIG. 2, can be embodied in several parts, for example, is seated in a frame 109, or in frame walls 109, and is mechanically pivotable around a center axis R103, which extends parallel with respect to the axes of rotation R104, R106, wherein the two pairs of support arms 101, 102 are seated, preferably offset from each other by 180° with respect to the center axis R103. Cones 111, which receive a roll core, can be rotatorily driven, for example by use of a belt drive, or by a drive motor 112 on a cone 111 for each pair of support arms 101, 102. The respective other cone 111 is typically not driven.

For example, the axial positioning of the respective support arm 101, 102 is performed by a control and/or by a regulating device 114, which is only schematically indicated, by the use of a reference value y-soll for the position of the roll 104, 106, or y-soll,i for the support arms 101, 102 which, for example, has been manually preselected, for example from the operating console, or by a press control device. The reference values y-soll,i for the support arms 101, 102 can also be formed in the control device 114 or in any other manner, for example from the reference value y-soll. To detect the actual position y-ist of the respective support arm 101, 102, it is possible to assign a sensor device, which is not represented, to the drive mechanism and/or to the support 103, which reports the position back to the control and/or to the regulating device 114. A sensor can be omitted if the actual axial position is correlated, such as, for example, via a rotor position etc., and is present as information. If the actual position y-ist, obtained via the sensor device or the correlation, does not agree with the actual reference value y-soll, the control and/or regulating device 114 acts on the respective drive motors 107 by the use of an actuating command Delta 107. A control process can be provided in an advantageous manner, in which the roll, which is freshly placed on the shaft, for example the roll 106, is automatically aligned in the axial direction with respect to the roll 104, or with respect to web B, B', which is just running out, before the fresh web B, B' is glued to the running-out web B, B' by the operation of a gluing and cutting device 108, and the old web B, B' is cut off its roll 104, 106. By the use of the driven support arms 101, 102, it is also possible, and provided that, following the receipt of a fresh roll 104, 106, or prior to the start of production, the roll 104, 106 is automatically positioned in its axial position with regard to the desired path of the web edges, and the web edge is preset in this way. The control device of the roll changer 100 receives information regarding the planned production and/or preset values, respectively from the machine control device of the printing press.

In an advantageous embodiment of the present invention, the roll changer 100 is prepared so that it can be serviced from both sides, i.e. from the area of both frame walls 109. To this end, at least connecting locations, such as, for example, recesses, which can also be covered, in the frame wall and/or openings, which can be covered, for signal lines, for receiving an operating element 116, such as, for example, a display 116 with appropriate input or switch elements, are provided at least in both frame walls 109 in the course of their manufacture. Depending on the definition of a side I, typically the operating side I, which is provided in the course of setting up the press for its operation, in a first embodiment, the recess in the opposite side II can be closed off by a cover, which is not specifically represented, while the operating element 116 is installed on the side I that is intended for the operation of the press. In another embodiment, the roll changer can have an operating element 116, in principle, in both frame walls 109, i.e. in side I and in side II.

Equipping the roll changer 100 with operating element 116 on both sides or selectively on one side is of particular advantage within the scope of arranging the roll changer 100 in so-called left-right, as well as in right-left presses, without it being required to provide individual solutions with regard to construction and to manufacture. Left-right or right-left presses are intended to be understood in such a way that this indicates the transport direction T of the web B, B' when the press is observed from that side, on which operation of the press by the operators is intended, i.e. from the operating side I. Thus, in FIG. 1 this is a left-right press, if it is assumed that the viewer is located on the side I, as designated in FIG. 3. What has been said above also applies in the same way to the below described printing units 300, draw-in elements, switchgear cabinets 361, as well as to the linear traversing device 362, which is specially configured for this.

Figure 4:
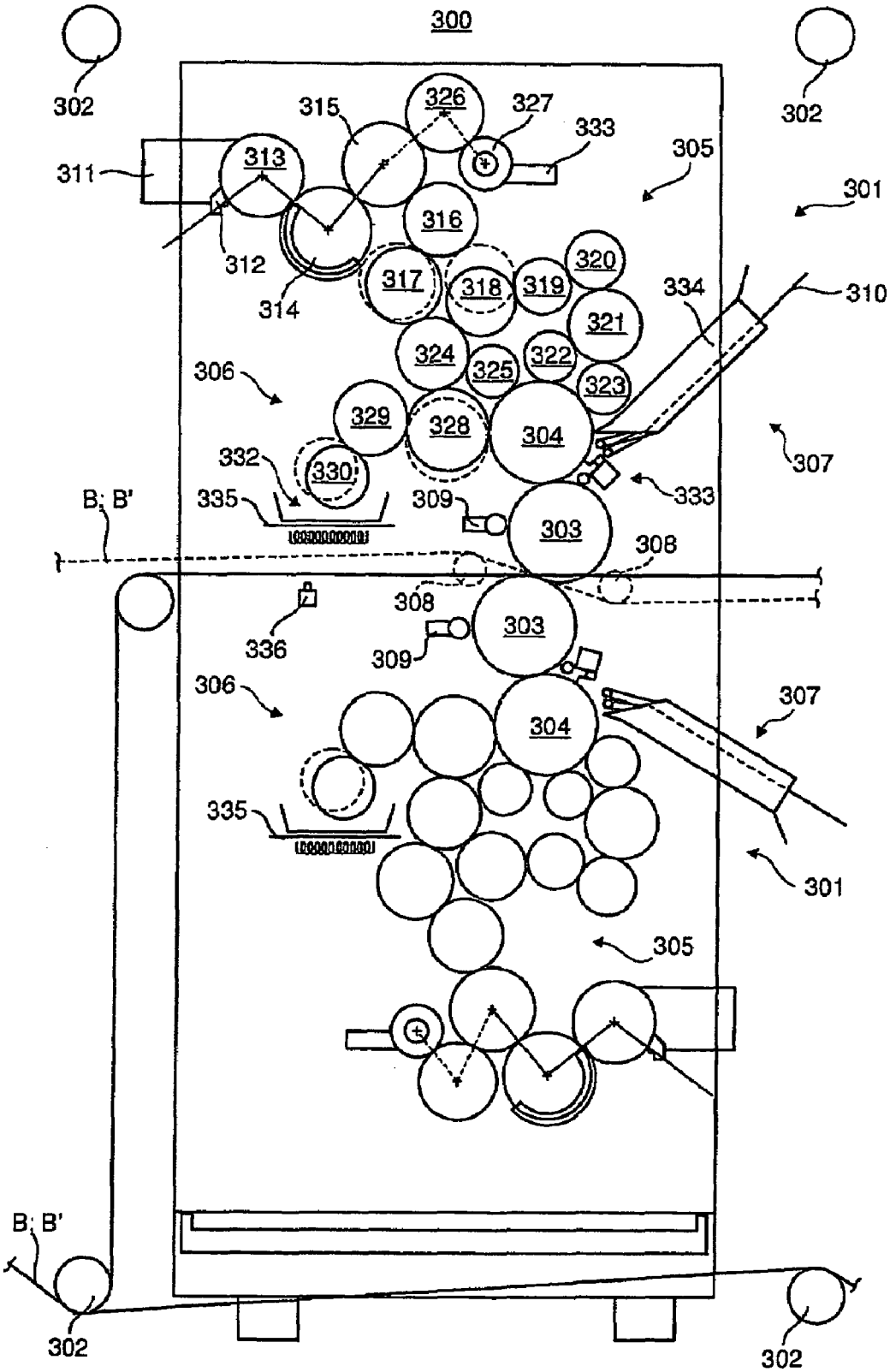

For accomplishing multi-color imprinting of the web B, B', the printing press has several, such as, for example, at least four, and here in particular five substantially identically equipped printing units 300. Preferably, the five substantially identical printing units 300 are arranged side-by-side, and the web B, B' passes through them horizontally. Preferably, each printing unit 300 is embodied for offset printing, and in particular is embodied as a double printing unit 300, or as an I-printing unit 300 with two printing groups 301, such as, for example, two offset printing groups 301 for imprinting both sides in a so-called rubber-against-rubber operation, as depicted in FIG. 4. Rollers 302 are arranged upstream and downstream at least in the lower area, and also optionally in the upper area, of at least one of the printing units 300, by the use of which, an incoming web B, B' can be conducted around the printing unit 300 at the bottom or at the top, a web B, B' which had been conducted around the upstream arranged printing unit 300 can be conducted through the printing unit 300, or the web B, B' conducted through the printing unit 300 can be conducted around the downstream located printing unit 300.

FIG. 4 schematically represents the arrangement of two printing groups 301 acting together via the web B, B', each with cylinders 303, 304, with cylinder 303 being designed as a transfer cylinder and with cylinder 364 being designated as forme cylinder 304, which cylinders 303, 304 are also called printing group cylinders 303, 304, an inking unit 305 and a dampening unit 306. In an advantageous embodiment, the printing unit 300 has devices for use in accomplishing either a semi- or a fully automatic plate feeding 307, or for the change of a printing forme 310, for each forme cylinder 304.

In a further development, and in particular if the printing press is intended to be suitable for imprint operations, at least one, or possibly several of the printing units 300 have additional guide elements 308 positioned closely in front of, and after the nip point of the printing unit 300. If a passage through a printing unit 300 is to take place, without imprinting of the web, and without contact between the web B, B' and the transfer cylinders 303, the web guidance, which is indicated by dashed lines in FIG. 4, and which is accomplished by using the guide elements 308, is advantageous. The web B, B' passes through the nip point in such a way that it substantially forms an angle of between 80° and 100°, and for example of approximately 90°, with a connection line connecting the axes of rotation of the two transfer cylinders 303. The guide elements 308 are preferably configured as rods or as rollers, around which air circulates. This reduces the danger of freshly imprinted ink being rubbed off by contact with these rollers 308.

In a further development of the printing group 301 depicted in FIG. 4, a washing device 309 is assigned to each transfer cylinder 303. The elastic surface of the transfer cylinder 303 can be cleaned by use of the washing device 309.

Each of the cylinders 303, 304 has a circumference between 540 and 700 mm. The forme and transfer cylinders preferably have the same circumference. The circumferences advantageously lie between 540 and 630 mm. In a special embodiment, the section length "a", as seen in FIG. 2, lies between 620±10 mm. In a further development, the printing unit 300 is configured in such a way that, with a few small changes, it is possible to structure it with cylinders 303, 304 of a circumference of selectively 546 mm, 578 mm, 590 mm or 620 mm. For example, merely an exchange of bearing elements, or a changed position of the bores in the lateral frame, and of the boss; as discussed, in connection with the cylinders 303, 304 and the matching of the drive mechanism or lever, as also discussed below, takes place.

The transfer cylinder 303 has at least one dressing, which is not specifically represented, on its circumference, which at least one dressing is maintained in at least one groove which is extending axially on the shell face. Preferably, the transfer cylinder 303 has only one dressing extending over the cylinder effective length, or substantially over the entire width of the web B, B' to be imprinted, and substantially, except for a joint, or a groove opening, over the entire circumference of the transfer cylinder 303. The dressing is preferably configured as a so-called metal printing blanket, which has an elastic layer, such as, for example, rubber on a substantially dimensionally-stable support layer, for example a thin metal plate. The ends of this dressing are then introduced into the groove, through an opening in the shell face, and are held there positively or frictionally engaged. In the case of a metal printing blanket, the dressing ends are bent or are beveled, for example, in the area of a leading edge by approximately 45°, and in the area of a trailing end by approximately 135°. These bent or beveled ends extend through an opening of a groove, which groove extends axially over the entire useful width of the transfer cylinder 303 and which groove also has, for example, an arresting, clamping or tensioning device. In the area of the shell face, the opening to the groove preferably has a width, in the circumferential direction of the cylinder 304, of 1 to 5 mm, and in particular of less than or equal to 3 mm. The clamping device is preferably made to be pneumatically actuable, such as, for example, in the form of one or of several pneumatically movable levers which, in the closed state, are prestressed, by application of a spring force, against the trailing end of the dressing placed in the groove. A hose, which can be charged with a pressure medium, can preferably be used as the actuating device.

Besides an ink supply device, such as, for example, an ink fountain 311 with an actuating device 312 for regulating the ink flow, the inking system 305 has a plurality of rollers 313 to 325. The ink supply device 311 can also be embodied as a doctor blade crosspiece. With the rollers 313 to 325 of the inking system 305 placed against each other, the ink moves from the ink fountain 311, via the ductor roller 313, the film roller 314 and a first inking roller 315 onto a first distribution cylinder 316. Depending on the mode of operation of the inking system 306, as described below, the ink reaches at least one further distribution cylinder 321, 324 via at least one inking roller 317 to 320, and from there via at least one application roller 322, 323, the ink reaches the surface of the forme cylinder 304. In an advantageous embodiment, the ink moves from the first distribution cylinder 316 via different possible paths selectively or simultaneously, either in series or in parallel, via two further distribution cylinders 312, 324, to the application rollers 322, 323, 325. In an advantageous embodiment of the inking and dampening system 305, 306, the second distribution cylinder 324 can simultaneously work together with a roller 328, which roller 328 may be, for example, the application roller 328 of the dampening system 306.

In a further development, the inking system 305 has, in addition to the rollers 313 to 325, at least one further roller 326, by the use of which further roller 326, ink can be taken from the inking system 305 in the ink path, in particular upstream of the first distribution cylinder 316. This occurs in that an appropriate removal device 333 can be placed against the roller 326 itself or, as represented in FIG. 4, against a roller 327 that is working together with the roller 326.

The roller 328 works together with a further roller 329 of the dampening system 306, such as, for example, a distribution roller 329, and in particular, a traversing chromium roller 329. The chromium roller 329 receives the dampening agent from a dampening installation, such as, for example, a roller 330, and in particular a fountain roller 330, which dips into a dampening agent supply 332, such as, for example, a water fountain. A drip plate 335, for use in catching condensation water forming on the water fountain, is preferably arranged underneath the water fountain and, in an advantageous embodiment, is embodied so that it can be heated, such as, for example, by the use of heating coils. A rotatory individual drive mechanism, which is not visible in FIG. 5, and in particular a drive motor, is provided for the distribution roller 329 and for the fountain roller 330, and rotatorily and individually drives the respective rollers 329, 330 individually, independently of each other via a bevel or an angular gear. The drive motor is preferably configured as an electric motor which is controllable, in particular continuously, with respect to its number of revolutions, and in particular is a rotary current motor. The setting of the numbers of revolution, or of the degree of dampening, can take place, in an advantageous manner, from the control console, such as, for example, the ink control console, where these settings are also displayed. In a preferred embodiment, a correlation between the press speed and the degree of dampening, or the number of revolutions, is stored in the press control device, by the use of which, the number of revolutions of the two rollers 329, 330, and in particular that of the roller 330, can be preset.

In an advantageous embodiment, the rollers 317, 318, 328 are arranged to be movable in the way which is indicated by solid lines and the dashed lines of FIG. 4. Movability of the rollers 317, 318, 328 should be understood in this context not to be the customary setting for adjusting purposes, but instead is understood to be the operational movability for changing from one operating position into another operating position. This means that actuating members, which can be changed either manually or by the use of drive mechanisms, and/or of detents, such as, for example, adjustable detents, are provided for one, as well as for the other type of operation. Moreover, an increased permissible actuating path is provided, or the roller arrangement has been selected in such a way, that the two respective positions can be achieved over the customary actuating path.

In an advantageous embodiment, the chromium roller 329, as well as the roller 330, are each seated, for example in levers, which rollers are movable in a direction perpendicular, with respect to their axes, so that the position of the application roller 328 can be changed in the above-mentioned way.

Figure 5:
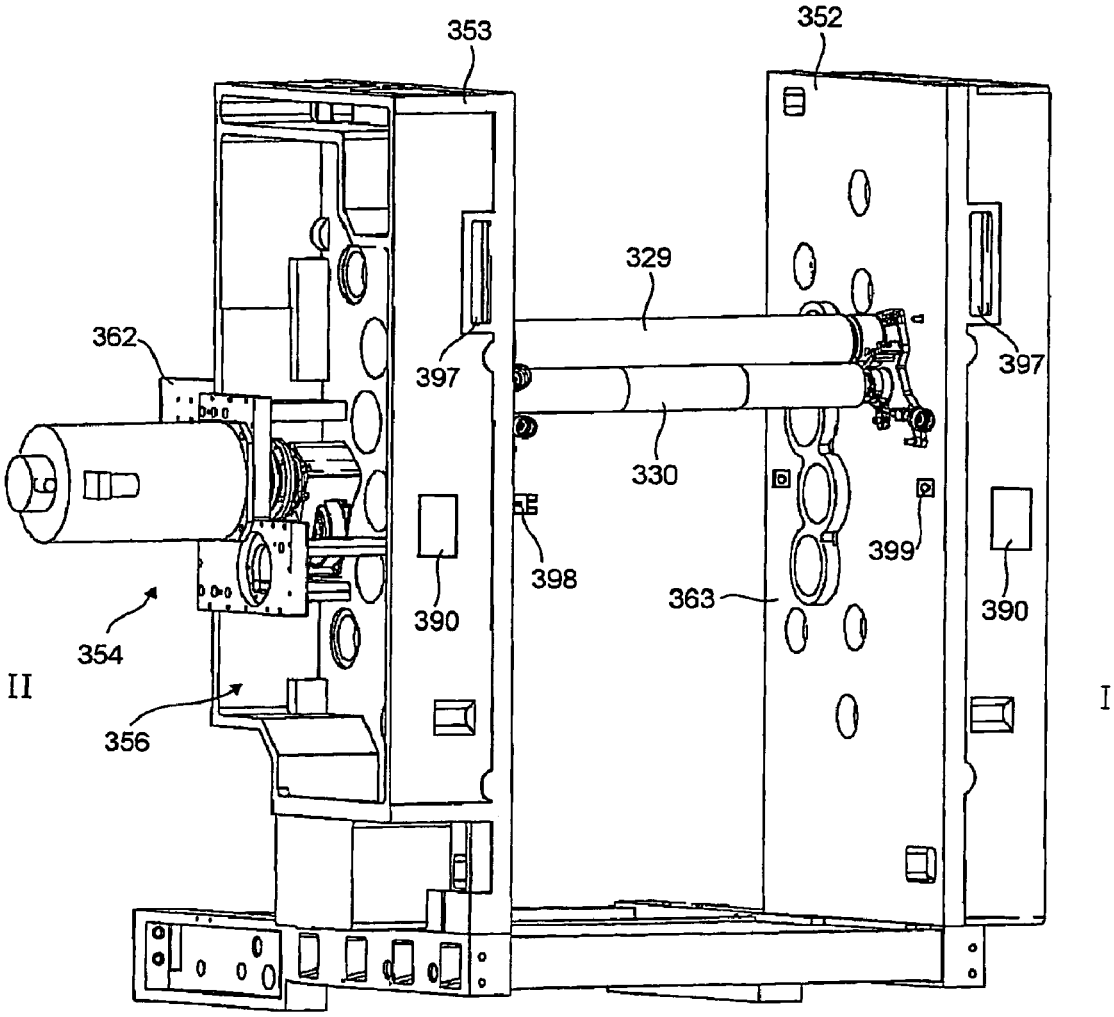

The distribution cylinders 316, 321, 324 of the inking system 305, as well as the roller 329 of the dampening system 306 are seated in lateral frames 352, 352, or in frame walls 352, 353, as seen in FIG. 5, and are axially movable in such a way that they can perform a traversing movement. For the distribution cylinders 316, 321, 324 and the roller 329, the traversing movement takes place in a forced manner, such as, for example, by the use of appropriate gears which are coupled with the respective rotatory drive. A seating which also permits traversing movements is also provided for the roller 328 and for the application roller 323. In contrast to the first mentioned distribution cylinders 316, 321, 324 and the roller 329, the axial movement of the rollers 328 and 323 is caused only by friction between the cooperating shell faces, and not by the provision of an appropriate gear for traversing movements. Optionally, it is also possible to provide such seating, which allows degrees of freedom in the axial direction, for the two application rollers 322 and 325.

The arrangement, which is shown in solid lines in FIG. 4 in the inking and dampening system 305, 306, respectively, shows the interaction of the rollers 313 to 325 provided for "normal" printing operations. The inking and dampening agent paths are also in connection with each other, besides the forme cylinder 304. Besides direct dampening, there is also indirect dampening.

By the movability, or the displaceability, of the roller 328, a choice is possible between direct dampening in the "three roller dampening system" and, as a function of the position of the roller 317, indirect dampening, or direct dampening in the "five roller dampening system".

Each of the rollers 303, 304, and the rollers 313 to 330 of the inking and dampening systems 305, 306 is seated with their ends located in, or on, the frame walls 352, 353. However, only the rollers 329 and 330, as well as the main drive 354 of the printing unit, which is also explained below, are represented, by way of example, in FIG. 5.

Figure 6:
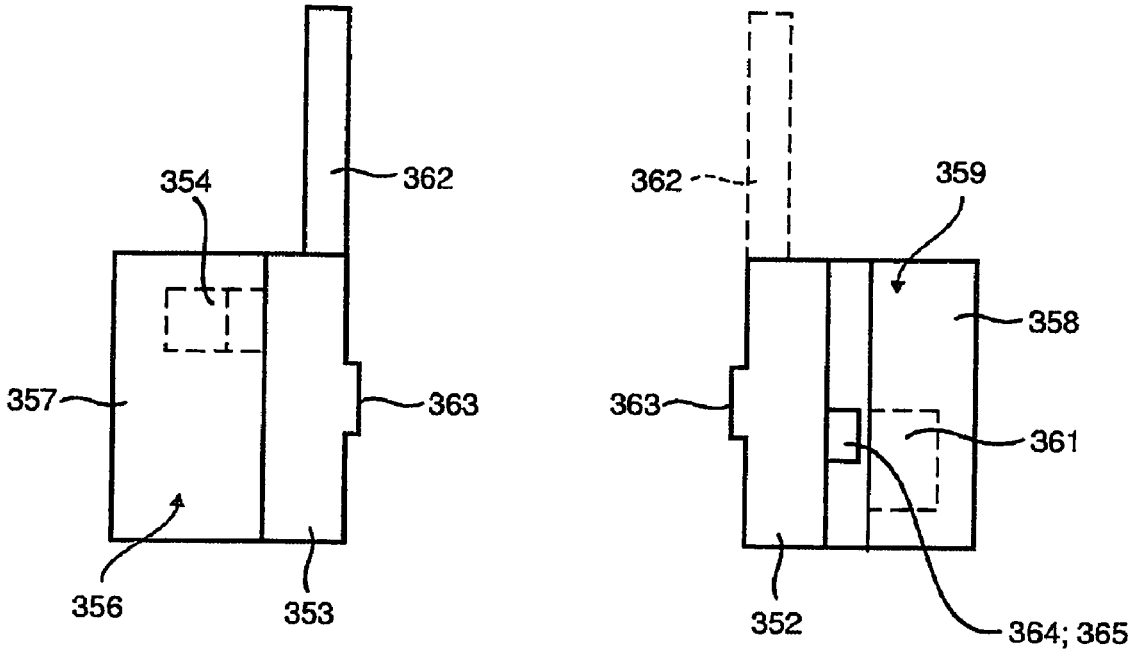

One of the frame walls 352, 353, and in particular the wall on the side of the main drive 354, is embodied in one or in several pieces in such a way that it is possible to form a hollow space 356, which can be closed, such as, for example, a lubricant space 356, which extends at least over an area which covers the ends of all of the cylinders 303, 304, and rollers or distribution cylinders which are in mechanical driving connection, and in particular of all of the distribution cylinders 316, 321, 324 of the inking system 306. As schematically represented in FIG. 6, a releasable cover 357 for the hollow space 356 is provided at the outer face of the frame 353. The other frame wall 352 also forms a hollow space 359 which is closed by a releasable cover 358 which is arranged at the outer face, and in which hollow space 359 the switching and control devices 361, shown in dashed lines, of the printing unit 300, for example in the form of a switchgear cabinet 361, as well as other devices, are housed. In contrast to an arrangement of the switching and control devices 361 between the printing units 300, the advantage rises, because of the arrangement of the switching and control devices 361 in the frame hollow space 359, that the space between two printing units 300 is accessible from both sides. Therefore, an operating side I of the printing press is freely selectable in principle responsive to whether the press is, as discussed above, a left-right press, or a right-left press. This is additionally aided in that a linear traversing device 362, which is used for connecting the printing units 300, can be selectively arranged at the frame wall 352 or 353. In FIG. 6, the linear traversing device 362 at the frame wall 352 is represented in dashed lines. Thus, the arrangement of this linear traversing device 362 defines the operating side I as the side which is located opposite the traversing device 362, and in the other way, the arrangement of the traversing device 362 results from the selection of the operating side I. Prepared connecting points 397 for the selective arrangement of the traversing device 362 are provided in the course of manufacturing the frames 352, 353. For example, these connecting points 397 can be configured in the manner of flanges with surface-treated areas, in contrast to rough cast material, and with bores for attachments.

The same optionally applies to the preparation of a draw-in arrangement 399 which may be, for example, embodied as a draw-in guide device 399 for a draw-in mechanism, that is not represented, through the printing unit 100. In this case, respective connecting points 398, such as, for example, a finished surface with a bore or bores, for receiving the draw-in guide device 399, can be prepared in both lateral frames 352, 353. Also, suitable, but not represented supply channels for energy, signal lines, or operating mechanisms between the printing units 300, or appropriate connecting points for them, can already be prepared in both lateral frames 352, 353. In this case, these supply channels extend, for example, on the finally selected side II, and preferably in the area of the linear traversing device 362.

As mentioned above in connection with the roll changer 100, it is possible, in an advantageous manner, to prepare, at least in each one of the frame walls 352, 353, a recess and/or a connection point, such as, or example, a recess in the frame wall, which can be covered, or openings for signal lines, which can also be covered, for an operating element 390, such as, for example, a display 390, including appropriate input or switching elements, such as, for example, a touch-sensitive display.

It can be seen in FIG. 6 that the individual rotatory drives 364, 365 of the rollers 329, 330 are arranged on the side of the press opposite the main drive 354.

On the side or end which is opposite the rotatory drive, the roller 329 has a traversing drive mechanism, which is not specifically represented, and in particular has a gear for creating an axial traversing movement from the roller rotatory movement. Preferably, this traversing gear is arranged outside of the roller body in order to avoid the creation of spot heating in the roller 329. In an advantageous embodiment, this gear is located on the drive side of the printing group 300, i.e. in the area of the same frame wall 353 as the main drive 354 and/or in the area of a drive train of the printing group cylinders 303, 304, but the rotatory drive mechanism of the rollers 329 and 330 on the opposite side, i.e. in the area of the frame wall 352. If the hollow space 356 is embodied as a lubricant space 356, the gear for accomplishing the axial traversing movement can be arranged therein as an open, not specially lubricated gear. On the side of the frame which is remote from the gear used for accomplishing the axial traversing movement, the roller 329 is connected with the motor shaft of the drive motor 364, by, for example, a corner or bevel gear and an angle-compensating coupling and by a coupling in such a way that a rotatory movement is transmitted, while an axial movement of the roller 329, with respect to the shaft, is possible.

On the side of the frames facing the cylinders 303, 304, the frame walls 352, 353 each have a shoulder 363 protruding out of the straight line or plane of each of the respective housing wall 352, 353. Advantageously, the shoulder 363 is formed in one piece with the frame wall 352, 353 and is advantageously produced as a so-called boss 363 in the course of production the frame in a casting mold. The boss 363 has bores extending through it and also through the straight line of the frame wall 352, 353 for use in receiving non-represented bearings. The boss 363 extends, in particular continuously, over the end area of the forme cylinders 303 and the transfer cylinders 305, but does not extend over the end areas of the traversing and/or traversable inking or dampening system rollers.

As can be seen in FIG. 5, the driving of the cylinders 303, 304 of the printing unit 300 takes place by the provision of a main drive 354, such as, for example, an electric motor 354 which is fixed in place on the frame, and which, in particular, is an electric motor 354 whose angle of rotation position can be regulated, and which advantageously is configured to be water-cooled. Preferably, driving is performed via a gear, such as, for example, by a gear wheel or a belt gear from the drive motor to at least one of the cylinders 303, 304.

Figure 7:
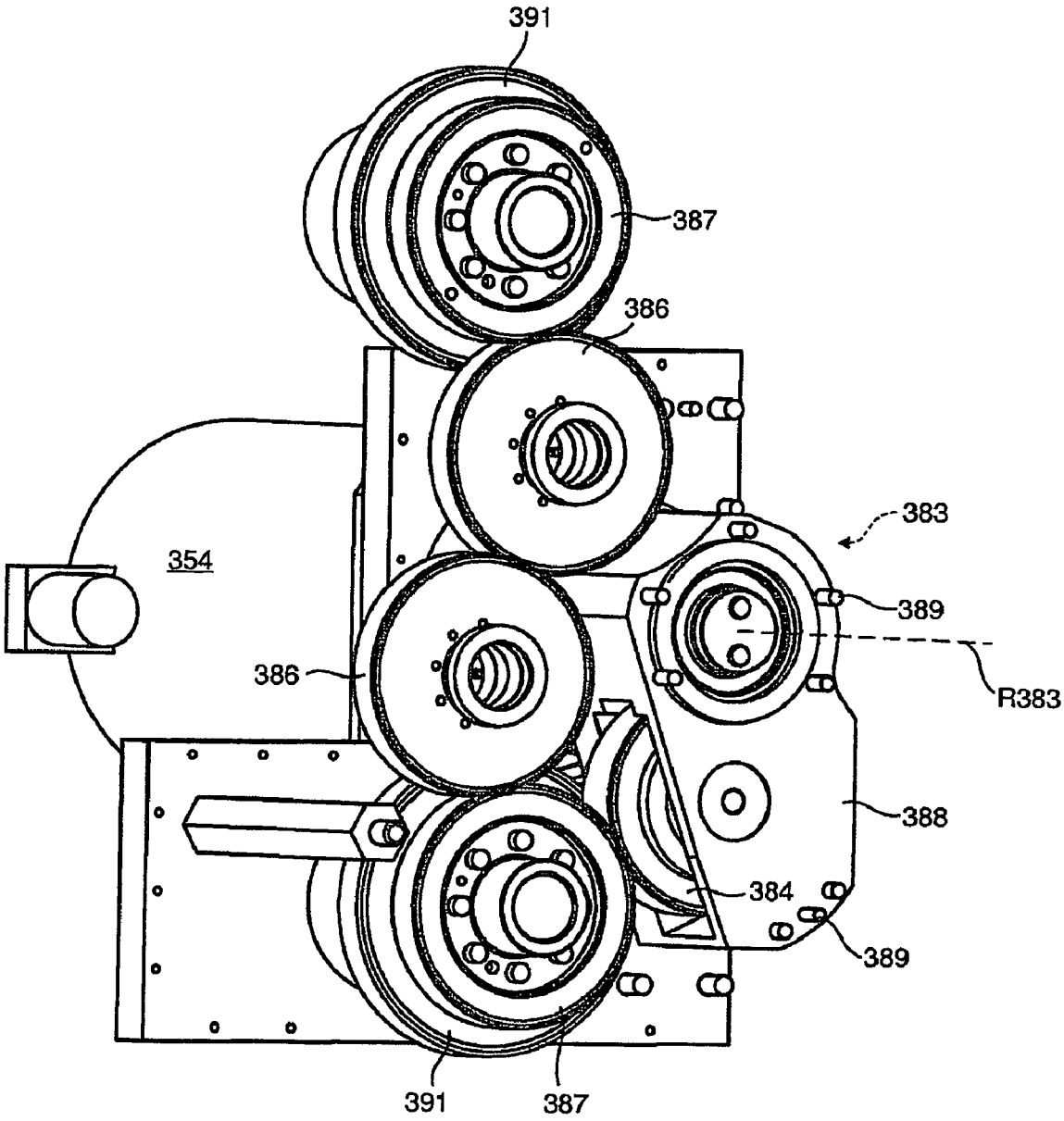
FIG. 7, a representation of a drive train of the printing group cylinders, in FIG. 8, a schematic representation of the drive train to the inking system, in FIG. 9, a top plan view of a first printing press system, and in FIG. 10, a top plan view of a second printing press system.

In FIG. 7 the arrangement of the drive mechanism is represented, as viewed from the frame wall 353 toward the outside. By use of its pinion gear 383, as indicated by the dashed arrow, which is not visible in FIG. 7, the electric motor 354 does not drive a drive wheel 386, 387 of one of the cylinders 303, 304 directly, but instead drives these drive wheels or gears via an intermediate wheel or gear 384. The intermediate wheel or gear 384 is seated in a lever 388, which is seated, and which is pivotable in principle, around an axis of rotation R383 of the pinion gear 383. With a fixed position of the electric motor 354, with respect to the frame wall 353 of the frame, it is possible, in connection with printing units 300 with different formats, in a simple manner to make an adjustment to accommodate different cylinder circumferences, and therefore to accommodate different circumferences of the drive wheels 386, 387. Depending on the format of the printing units 300, the lever 388 is pivoted, in the course of assembly, in such a way that the intermediate wheel 384 is in optimal engagement with the respective drive wheel 386, 387. Fixation elements 389, such as, for example, bolts 389 and corresponding, non-represented bores, located at the drive unit and/or at the frame wall 353, are advantageously provided, by the use of which, following assembly, the aligned lever 388 can be fixed in place in the appropriate position with respect to the frame wall 353 and/or with respect to the electric motor 354. Preferably, the bores, which are relevant to the respective format, are already prepared in the course of manufacturing the components in the factory. In a printing unit 300, or in a printing press, for a first format of a section length "a", the lever 388 is fixed in a different angle position, in respect to a vertical line, than in a printing unit 300, or in a printing press, for a second format of a different section length "a", while the electric motor 354 keeps its position with respect to the frame wall 353.

In a variation, the four printing group cylinders 303, 304 are driven in pairs, each via drive wheels 386, 387 of coupled forme and transfer cylinders 303, 304, by their own drive motors 354, by, for example, a pivotable intermediate wheel 384. In principle, a single, mechanically independent drive mechanism, with or without intermediate wheels 384, of each printing group cylinder 303, 304 is possible.

Basically, driving can be performed from the intermediate wheel 384, if provided, to any desired one of the drive wheels 386, 387. However, driving is preferably initially performed on the drive wheel 387 of one of the two forme cylinders 304. From there, driving takes place to the drive wheel 386 of the associated transfer cylinder 303, from there to the other transfer cylinder 303, and finally to the second forme cylinder 304. The drive wheels 386, 387 are connected, fixed against relative rotation, with their respective cylinders 303, 304, by, for example, journals. Rotatory driving of one, or of several rollers 313 to 327 of the associated inking system 305 takes place via further drive wheels 391, which are connected, fixed against relative rotation, with the two forme cylinders 304. In an advantageous manner, the distribution cylinders 316, 321, 324 are rotatorily driven from the direction of the forme cylinder 304 via a positive drive connection. The ductor roller 313 has its own rotatory drive mechanism, such as, for example, its own, mechanically independent drive motor, which is not specifically represented. The remaining rollers 314, 315, 317 to 320, 322, 323 and 325 to 327 of the inking system 305 are rotatorily driven only by friction, and, if required, are also shiftable axially, as discussed above.

Figure 8:
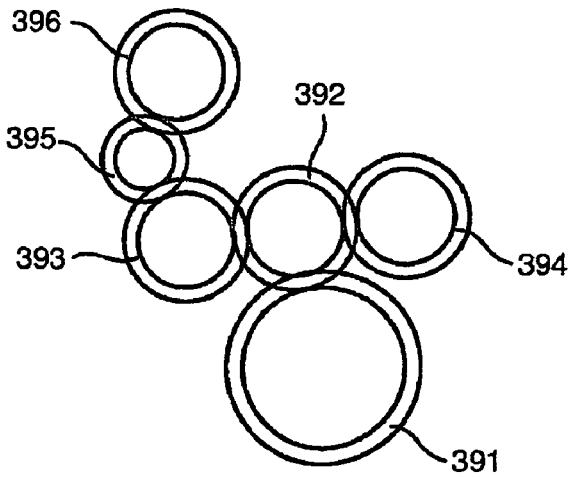

In an advantageous manner, driving is performed from the drive wheel 391 via an intermediate wheel 392, which is located parallel to drive wheels 393, 394 of the two distribution cylinders 321, 324, as seen in FIG. 8. The intermediate wheel is preferably configured to be coupled in or out, so that the drive train and the forme cylinder 304 can be mechanically separated from each other. Driving is performed from the drive wheel 393 of the distribution cylinder 324, via a further intermediate wheel 395, to a drive wheel 396 of the distribution cylinder 316. Preferably, the drive wheel or the intermediate wheels 392 to 396 are provided as gear wheels 392 to 396. The drive connections are embodied in such a way that an axial movement of the drive cylinders 316, 321, 324 is made possible.

As discussed above, the configuration of a press, with regard to the equipping of the units 100, 300 on both sides, or selectively on only one side, in relation to the roll changer 100, with operating element 116, and/or the printing unit 300, with linear traversing device 362, connecting point 397, draw-in guide device 398, or connecting point 397 and/or operating element 390, or its connecting point, is of particular value in accordance with a first requirement, or configuration type, as a left-right press, and in accordance with a second requirement, or configuration type, as a right-left press. It is possible, in the course of this, to employ the same elements in each case, in particular with the substantially identical equipment characteristics. in this way, a series construction and manufacture is possible.

Figure 9:
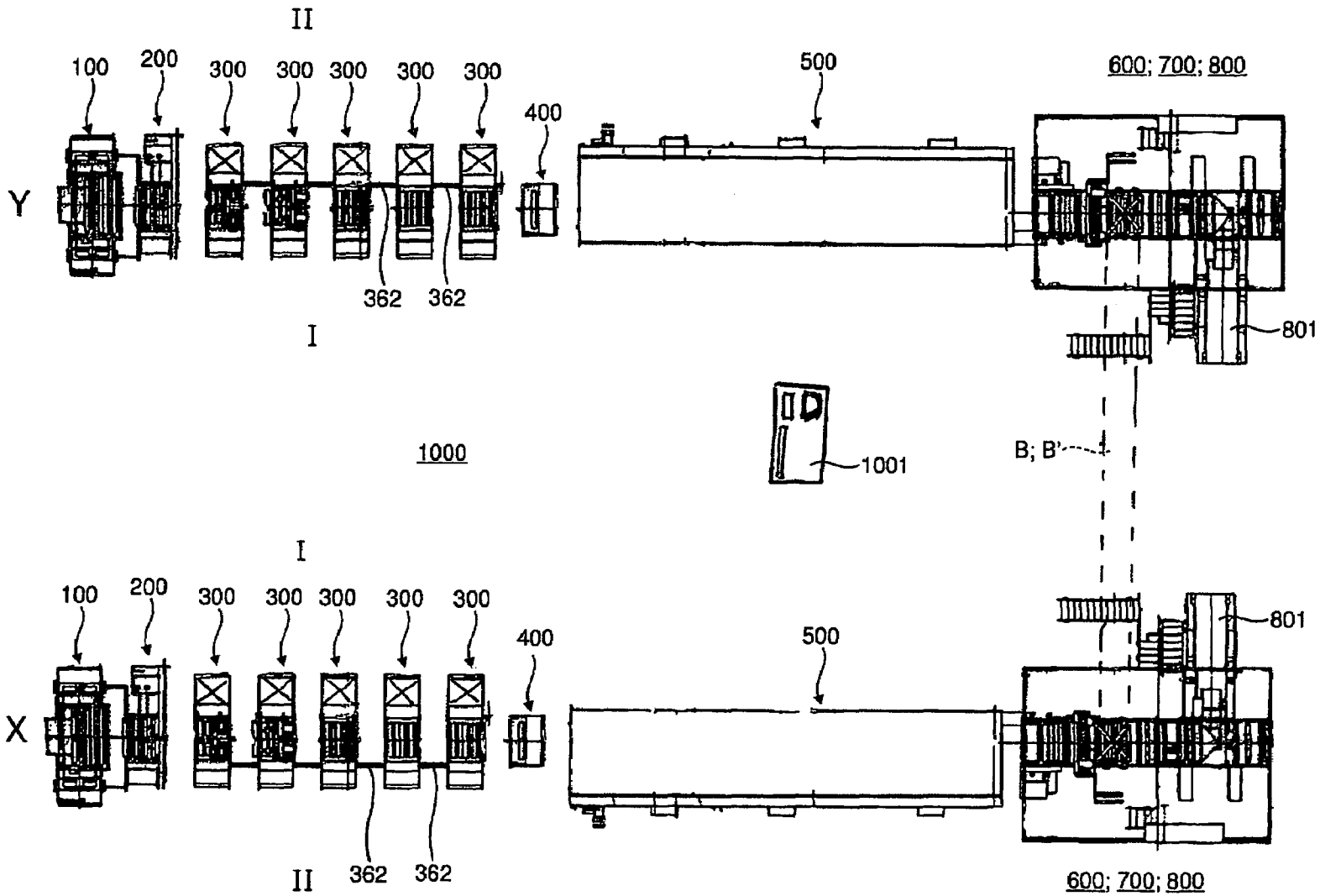
Figure 10:
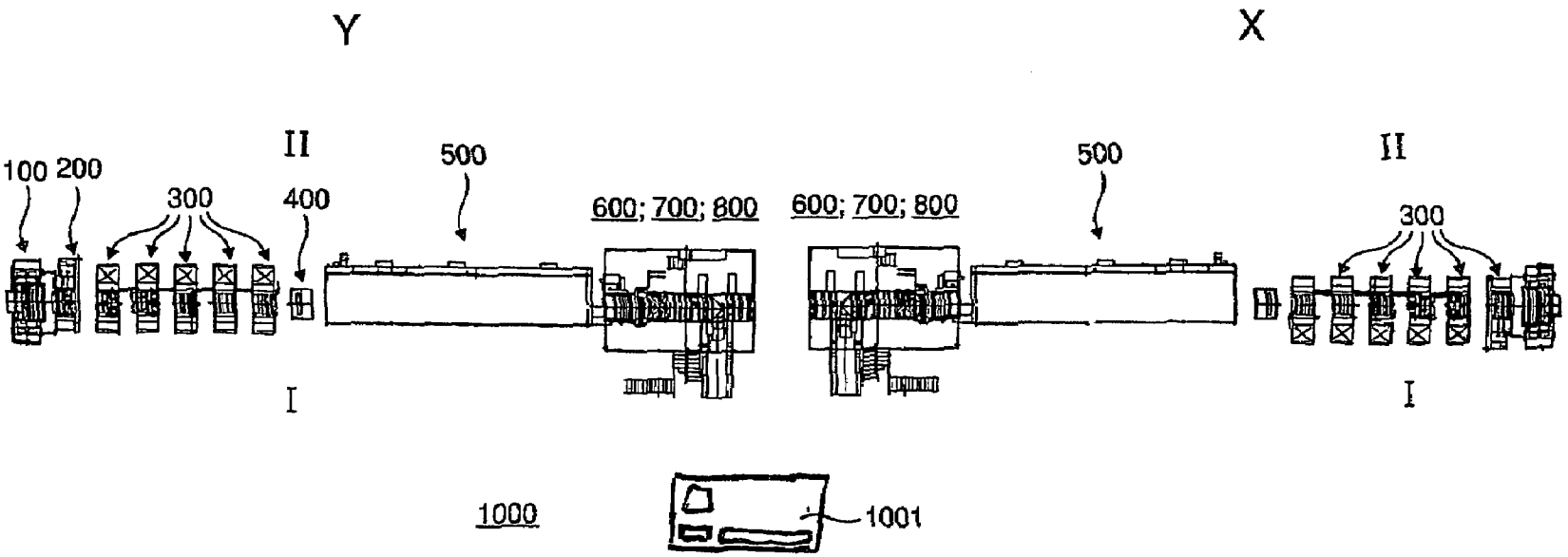

Thus it is possible, for example, in a first embodiment, or a first type, as depicted in the top part of FIG. 9 and as represented by "Y", to embody a printing press as a left-right press, wherein the rotatory drive motors 354, the rotatory drive mechanism, or drive side of the printing group cylinders 303, 304, merely indicated by (x) in FIGS. 9 and 10, which are independent of each other, are arranged on the side II, i.e. the side facing away from the operating side I of the printing units 300. The traversing devices 362 and/or a possibly provided draw-in device 398, are also located on this side. In addition, at least one operating element 116 of the roll changer 100 and/or an operating element 390 of each printing unit 300 is also located at the lateral frame 352, 353 of the operating side I, which can also be defined in this way. Here, the same elements can be used in the same embodiment.

If, because of spatial or of logistic circumstances of the print shop, a previously mentioned printing press should be configured in a second embodiment, or as second type which, in FIG. 9 is represented at the bottom as "X", as a right-left press, the rotatory drive motors 354, which are independent of each other, are arranged on the side I, the operating side of the printing units 300. In addition, at least one operating element 116 of the roll changer 100 and/or an operating element 390 of each printing unit 300 is located on the lateral frame 352, 353 of the operating side I. The traversing devices 362 and/or a possibly provided draw-in device 398, are located on the side II, i.e. the side of the printing units 300 facing away from the operating side I.

Thus, in connection with the two above-mentioned printing presses X, Y depicted in FIG. 9, a differentiation is not made between the operating side I and the drive side, but in accordance with that side I, from which a space between the adjoining units, and in particular between the printing units 300, is accessible to the personnel, operating side I or not, or is made difficult, side II. Depending on the type of the press, a drive side can then be located on the side I or the side II. In addition, the operating side I is preferably distinguished by the above mentioned arrangement of the operating elements 116, 390. The drive mechanisms, or drive sides, identified by (x) each have the drive motors 354, which are mechanically independent of other printing units 300, as well as advantageously also having the assigned, above-described drive train between the forme and transfer cylinders 304, 303 via the drive wheels 386, 387, either only a forme and transfer cylinder 304, 303 in pairs for drive motor 354, or all four printing groups cylinders 303, 304 with a common drive motor 354.

The advantages of the two described types X, Y, shown in FIG. 9, at the bottom and top, in regard to the above mentioned equipment and arrangement, also become particularly useful within the framework of a printing press installation with several, such as, for example, two printing presses X, Y arranged in a print shop with each having at least one material supply device 100 and at least one associated printing unit 300, respectively. As shown in FIG. 9, the two printing presses X, Y can preferably each be configured as complete presses, which therefore can be operated individually and independently of each other. In other words, both presses have one or have several units 400, 500, 600, 700, 800 and 900, which is not represented, for further processing. However, in principle a web B, B' can be conducted from one press to the other for one or for several further processing steps. This can be advantageous if one of the presses does not have one or several of the units 400, 500, 600, 700, 800 and 900, which is not represented for further processing or, if, for reasons of production or the product, webs B, B', or partial webs from both presses are intended to be conducted on top of each other.

FIG. 9 as a whole represents two printing presses X, Y in a printing press installation, which two printing presses are laterally spaced apart with respect to each other. The longitudinal axes, in the production direction, of the presses extend substantially parallel, but are spaced apart from each other to such an extent, that a space 1000 remains between the presses, which space 1000 is accessible to the personnel who are responsible for operating the presses. At least one operating console 1001 of the installation, such as, for example, a control console 1001, or several such control consoles 1001, can preferably be arranged in this space 1000, from which control console or consoles 1001 the two presses can be operated.

One of the presses now has at least one printing unit 300, in particular has all of the associated printing units 300, with its drive motor 354, or their drive motors 354, on the operating side I facing the space 1000, while the other press has at least one printing unit 300 and in particular has all of the associated printing units 300 with its drive motor 354, or their drive motors 354, on the side II facing away from the space 1000, or from the operating side I. Regarding the arrangement of operating elements 116, 390, the draw-in device 398 and/or the traversing device 362, reference is made to what was said above.

FIG. 10 represents two printing presses X, Y in a printing press installation, which are spaced apart from each other in the longitudinal direction. The longitudinal axes or the production direction of the presses extend substantially parallel to each other and are aligned. The space 1000, which can be accessed by the personnel who are responsible for operating the presses, is located on the same side, the operating side I, of the two aligned presses and can preferably again have an operating console 1001.

At least one of the presses has at least one printing unit 300, and in particular has all of the associated printing units 300, with its drive motor 354, or their drive motors 354, on the operating side I facing the space 1000, while the other press has at least one printing unit 300, and in particular has all of the associated printing units 300 with its drive motor 354, or their drive motors 354, on the side II facing away from the space 1000, or the operating side I. Regarding the arrangement of operating elements 116, 390, the draw-in device 398 and/or the traversing device 362, reference is made to what was described above in connection with the left-right and right-left press, together with FIG. 9.

In the arrangements in accordance with FIGS. 9 and 10 the delivery 801 of the folded product produced by each of the two presses takes place in the direction toward the space 1000, or toward the side I. This delivery occurs, in one of the presses, on the side having the drive motors 354 of this press, and in the other press the delivery occurs on the side of the press which is facing away from the drive motors 354 of the first press.

In a further development, the printing unit 300 has, in its entry area, or in the area of its inlet nip between the two transfer cylinders 303, a device for affecting the fan-out effect 336. Such a device is used for influencing a change caused, for example, by the printing process, and in particular by the moisture added by the dampening fluid, and resulting in the transverse extension or width of the web B, B', from one printing location to another printing location. Preferably, the device 336 for counteracting the fan-out effect 336 is arranged in the entry area of a second printing unit 300 which follows the first printing unit, or after the web has already been imprinted at least once. Device 336 has at least an actuating member, such as, for example, a support member, by the use of which the web B, B' can be deflected in a direction perpendicularly with respect to the web plane, while being touched or, advantageously without contact. The actuating member is configured, for example, as a nozzle through which air can flow.

As indicated in FIG. 4 and as already mentioned above, in an advantageous embodiment, the printing group 301 has the device 307 which is usable for the, at least partially automated, change of a printing forme 310, such as, for example, a flexible printing plate 301, on the assigned forme cylinder 304. The device 307 is configured in two parts and has a contact-pressure device 333, which is also called a "semi-automatic changing device" 333, and that is arranged in the area of a nip location between the forme cylinder 303 and the transfer cylinder 304, and a magazine 334, which is structurally separated from the contact-pressure device, with feeding and receiving devices for the printing formes 310.

While preferred embodiments of a printing machine and a printing machine system in accordance with the present invention, have been set forth fully and completely hereinabove, it will be apparent to one of skill in the art that various changes in, for example, the web being printed, the type of printing ink being used, and the like could be made without departing from the true spirit and scope of the subject invention which is to be limited only by the appended claims.

What is claimed is:

1. A printing press comprising:

at least a first web-fed rotary printing unit;

at least one pair of cylinders, including a forme cylinder and a transfer cylinder, in said at least first web-fed rotary printing unit;

first and second spaced lateral frames defining first and second sides of said at least first web-fed rotary printing unit, each of said first and second spaced lateral frames being adapted to receive an end of each of said at least one pair of cylinders for said at least first web-fed rotary printing unit;

a plurality of prepared connection points on each of said first and second lateral frames, each of said plurality of prepared connection points being adapted to selectively receive a printing unit operating element, each said printing unit operating element being usable for the control of functions of said at least first web-fed rotary printing unit, each said printing unit operating element being selectively positionable in at least one of said plurality of prepared connection points of one of said first and second lateral frames of said at least first web-fed rotary printing unit to define an operating side of said printing press; and at least one first cylinder drive motor for said at least one pair of cylinders in said at least first web-fed rotary printing unit, said at least one cylinder drive motor and each said printing unit operating element each being positionable in one of said plurality of prepared connection points on said one of said first and second lateral frames defining said operating side of said printing press.

2. The printing press of claim 1 further including a drive connection in said at least first web-fed rotary printing unit and mechanically coupling said forme cylinder and said transfer cylinder in said at least first web-fed rotary printing unit, said at least one first cylinder drive motor being engageable with said drive connection and being adapted to rotate said forme cylinder and said transfer cylinder through said drive connection, both said drive connection and said at least one first cylinder drive motor being also situated on said operating side of said printing press.

3. The printing press of claim 1 including a second web-fed rotary printing unit and further including said plurality of prepared connection points for each of said at least first and second web-fed rotary printing units.

4. The printing press of claim 1 further including a material supply unit and material supply unit frames having said prepared connection points for said operating element.

5. The printing press of claim 1 further including a web draw-in guide device attached to selected ones of said plurality of prepared connection points.

6. The printing press of claim 1 further including a second pair of cylinders in said at least first printing unit and further including a drive connection to couple said first and second pairs of cylinders for being rotatably driven by said at least one first cylinder drive motor.

7. The printing press of claim 3 further including a second pair of cylinders in said second web-fed rotary printing unit and a second drive connection, and further including a second cylinder drive motor adapted to drive said second pair of cylinders independently of said at least one pair of cylinders.

8. The printing press of claim 1 further including an imprinted and folded product delivery device located on said operating side of said at least first web-fed rotary printing unit.

9. A printing press installation comprising:

at least first and second web-fed printing presses;

at least one material supply unit associated with each of said first and second web-fed rotary printing presses;

at least first and second printing units in each one of said at least first and second web-fed rotary printing presses;

at least one drive motor adapted to drive each of said printing units of each of said at least first and second printing presses independently of other ones of said at least first and second printing units;

first and second lateral frames of each said printing press and forming a first, operating side of each said printing press and a second side of each said printing press and facing away from said operating side of each said printing press, each of said first and second lateral frames of each of said at least first and second web-fed rotary printing presses having a plurality of prepared connection points;

at least one operating element selectively connected to one of said prepared connection points on one of said lateral sides of each said printing press and defining said first, operating side, said at least one operating element being usable for the control of functions of each said printing press;

a first one of said at least first and second web-fed rotary printing presses having said at least one drive motor on said operating side of said first printing press; and a second one of said at least first and second web-fed rotary printing presses having said at least one drive motor on said second side opposite to said first, operating side of said second printing press.

10. The printing press installation of claim 9 wherein each said printing unit is driven independently by at least one drive motor.

11. The printing press installation of claim 9 wherein all of said printing units of said first printing press have said printing unit drive motors on said operating side.

12. The printing press installation of claim 9 wherein all of said printing units of said second printing press have said printing unit drive motors on said opposite side.

13. The printing press installation of claim 9 further including a linear traversing device connecting said at least first and second printing units of said first printing press remote from said first, operating side.

14. The printing press installation of claim 9 further including a first folded product delivery device associated with said first printing press and a second folded product delivery device associated with said second printing press, said first delivery device being oriented to said operating side of said first printing press, said second delivery device being oriented to said side of said second printing press facing away from said at least one printing unit drive motor.

15. The printing press installation of claim 9 wherein said first printing press and said second printing press are each provided with a longitudinal axis, said first and second printing press longitudinal axes extending parallel to, and spaced from each other.

16. The printing press installation of claim 9 wherein said first printing press and said second printing press are each provided with a longitudinal axis and further wherein said longitudinal axes are both aligned in a production direction of said first and second presses.

* * * * *